US009334772B2

(12) United States Patent
Sappok et al.

(10) Patent No.: US 9,334,772 B2
(45) Date of Patent: May 10, 2016

(54) PARTICULATE FILTER CONTROL SYSTEM AND METHOD

(71) Applicant: Massachusetts Institute Of Technology, Cambridge, MA (US)

(72) Inventors: Alexander Sappok, Cambridge, MA (US); Victor Wong, Peabody, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 22 days.

(21) Appl. No.: 14/063,415

(22) Filed: Oct. 25, 2013

(65) Prior Publication Data

US 2014/0116028 A1 May 1, 2014

Related U.S. Application Data

(60) Provisional application No. 61/719,701, filed on Oct. 29, 2012.

(51) Int. Cl.

| | |
|---|---|
| ***F01N 3/00*** | (2006.01) |
| ***F01N 3/02*** | (2006.01) |
| ***F01N 3/10*** | (2006.01) |
| ***F01N 3/20*** | (2006.01) |
| ***F01N 3/023*** | (2006.01) |
| ***F02D 41/02*** | (2006.01) |
| ***F01N 3/035*** | (2006.01) |
| ***F02D 41/14*** | (2006.01) |

(52) U.S. Cl.

CPC ..... *F01N 3/023* (2013.01); *F01N 3/035* (2013.01); *F02D 41/029* (2013.01); *F02D 41/1467* (2013.01); *F02D 2200/0812* (2013.01)

(58) Field of Classification Search

CPC ..... F01N 3/023; F01N 3/035; F02D 41/029; F02D 41/1467; F02D 2200/0812

USPC ..... 60/274, 277, 297, 299, 311

See application file for complete search history.

(56) References Cited

U.S. PATENT DOCUMENTS

| | | | |
|---|---|---|---|
| 7,524,360 | B2 | 4/2009 | Cheng |
| 7,679,374 | B2 | 3/2010 | Bromberg et al. |
| 8,384,396 | B2 | 2/2013 | Bromberg et al. |
| 8,384,397 | B2 | 2/2013 | Bromberg et al. |
| 2010/0101409 | A1 | 4/2010 | Bromberg et al. |
| 2010/0102828 | A1 | 4/2010 | Bromberg et al. |
| 2010/0135866 | A1 | 6/2010 | Mizuno et al. |
| 2010/0266461 | A1 | 10/2010 | Sappok et al. |
| 2012/0138093 | A1 | 6/2012 | Sappok et al. |
| 2013/0125745 | A1 | 5/2013 | Bromberg et al. |
| 2013/0127478 | A1 | 5/2013 | Bromberg et al. |
| 2013/0269528 | A1 | 10/2013 | Sappok et al. |

OTHER PUBLICATIONS

SAE International, SAE Technical Paper 2012-01-1732, published Sep. 10, 2012, doi: 10.4271/2012-01-1732, 11 pages, "Ash Transport in Diesel Particle Filters", Dittler.

Journal of Aerosol Science, vol. 35, 2004, pp. 805-821, doi: 10.1016/j.jaerosci.2004.01.002, "Microparticle detachment from surfaces exposed to turbulent air flow: Effects of flow and particle deposition characteristics", Ibrahim, et al.

(Continued)

*Primary Examiner* — Audrey K Bradley
*Assistant Examiner* — Dapinder Singh
(74) *Attorney, Agent, or Firm* — Nields, Lemack & Frame, LLC

(57) ABSTRACT

A system and method for controlling the operation of a particulate filter is disclosed. The objective of this control system is to manipulate the properties and spatial distribution of contaminant material accumulated in filters to reduce filter pressure drop and associated deleterious impacts of the contaminant material on filter performance.

24 Claims, 8 Drawing Sheets

(56) References Cited

OTHER PUBLICATIONS

SAE Int. J. Engines, vol. 4, Issue 1, pp. 527-536, SAE International, SAE Technical Paper 2011-01-0603, published Apr. 12, 2011, doi: 10.4271/2011-01-0603, "New Design Concept for Diesel Particulate Filter", Iwasaki, et al.

Proceedings of the ASME 2012 Internal Combustion Engine Division Fall Technical Conference, ICEF 2012, Sep. 23-26, 2012, Vancouver, BC, Canada, ICEF 2012-92104, pp. 1-13, "Microscale Study of Ash Accumulation Process in DPF Walls Using The Diesel Exhaust Filtration Analysis (DEFA) System", Viswanathan, et al.

International Search Report and Written Opinion mailed Mar. 5, 2014 in corresponding PCT application No. PCT/US2013/067000.

PARTICULATE FILTER CONTROL SYSTEM AND METHOD

This application claims priority of U.S. Provisional Patent Application Ser. No. 61/719,701, filed Oct. 29, 2012, the disclosure of which is incorporated herein by reference in its entirety.

BACKGROUND

Filters are used in a wide range of applications to remove contaminant material from a fluid flow. Often the accumulation of the contaminant material on the filter media negatively impacts the operation of the overall filtration system, through a restriction in flow through the filter and increased backpressure.

Over time particulate matter builds up in the filter. The particulate matter is composed of soot, defined as the combustible fraction which includes carbon, sulfates, and organic matter. Aside from the combustible fraction, the particulate matter also contains incombustible material or ash. The ash, generally composed of metal oxides, sulfates, and phosphates, may originate from lubricant additives, engine wear metals, trace metals in diesel fuels, and many other sources. While the combustible fraction of the particulate matter may be removed from the filter during regeneration, through oxidation, the incombustible material or ash remains.

Following extended use, the ash plugs the filter channels. The ash may accumulate on the filter walls, in an end plug at the back of the channel, in the filter pores, or some combination of these locations. The ash plugging restricts flow through the filter and leads to increased exhaust backpressure, which negatively impacts vehicle fuel economy. The ash also occupies a significant portion of the filter volume, reducing its soot storage capacity, and thus requiring more frequent filter regeneration. More frequent filter regeneration also leads to increased fuel consumption. Further, ash may also degrade the performance of catalysts used in these filter systems, and interact with the filter material itself, such as through sintering, pitting, and other means, which also degrades the integrity of the filter. The ash, thus, is one of the most important parameters limiting the service life of the filter. Once significant amounts of ash have accumulated in the filter, and its performance has degraded below a certain level, the filter must be removed for ash cleaning or replacement.

In order to mitigate the ash problem, larger filters may be used (over-sized) to provide additional storage space to accommodate the build-up of ash over time. The use of larger components incurs added costs, and takes up valuable space which could be used for other purposes.

The spatial distribution of the ash, as well as the physical ash properties, particle size, packing density, porosity, permeability, and the like are the most important parameters controlling the magnitude of the ash impact on the particulate filter. Therefore, a system and method for manipulating the ash properties and spatial distribution by varying the operation of the engine and aftertreatment system in a specific manner, would be beneficial.

SUMMARY

This invention relates to a system and method for manipulating the ash properties and spatial distribution by varying the operation of the engine and aftertreatment system in a specific manner, to mitigate the impact of the ash on filter performance. In some embodiments, the preferred profile may include a thin highly permeable ash membrane on the walls of the filter, with the majority of the ash densely packed in the end of the channel. Various techniques may be used to create this desired profile.

BRIEF DESCRIPTION OF THE DRAWINGS

FIG. 1(*b*) shows the reduction in particle breakthrough with 0.25 g/L ash addition in each successive trial.

DETAILED DESCRIPTION OF THE INVENTION

While this disclosure relates to any type of filter suffering from contaminant material-induced flow restriction, in one particular embodiment, the filter is a particulate filter. More specifically, the filter may be a honeycomb-type particulate filter, consisting of a plurality of channels, alternately plugged at each end, and commonly used to remove particulate matter from engine exhaust. The engine may be a diesel engine, gasoline engine, or any other type of internal combustion engine, or combustion source producing particulate matter.

This invention relates to a system and method for manipulating the ash properties and spatial distribution by varying the operation of the engine and aftertreatment system in a specific manner, to mitigate the impact of the ash on filter performance.

Throughput this disclosure, the word "particle" is used generically and intended to describe a larger range of deposits in the filter, including single particles, agglomerates of multiple particles, and bulk portions of the cake layer which may break or flake off the surface.

Although high levels of ash build-up in the filter generally produce negative impacts on the filter performance (plugging, flow restriction, catalyst masking, etc.) it has been experimentally determined that small amounts of ash, generally less than 10 grams of ash per liter of filter volume, can yield the following beneficial effects:

1. Reduction in soot-loaded filter pressure drop relative to the clean filter, and
2. Improvement in overall filter trapping efficiency.

The beneficial effects observed with these low ash levels require the following:

1. The ash be deposited to preferentially form a thin membrane along the filter walls, and
2. The ash membrane be of high permeability with relatively small pore size to prevent soot particles from entering the filter pores, but still minimize flow restriction through the membrane.

It has also been determined that the ash membrane need not be fully developed along the filter walls. Significant benefits may be obtained with very low ash levels, less than 0.5 grams per liter of filter volume (g/L), in some cases, as long as the ash accumulates in or bridges the surface pores.

Figure 1:
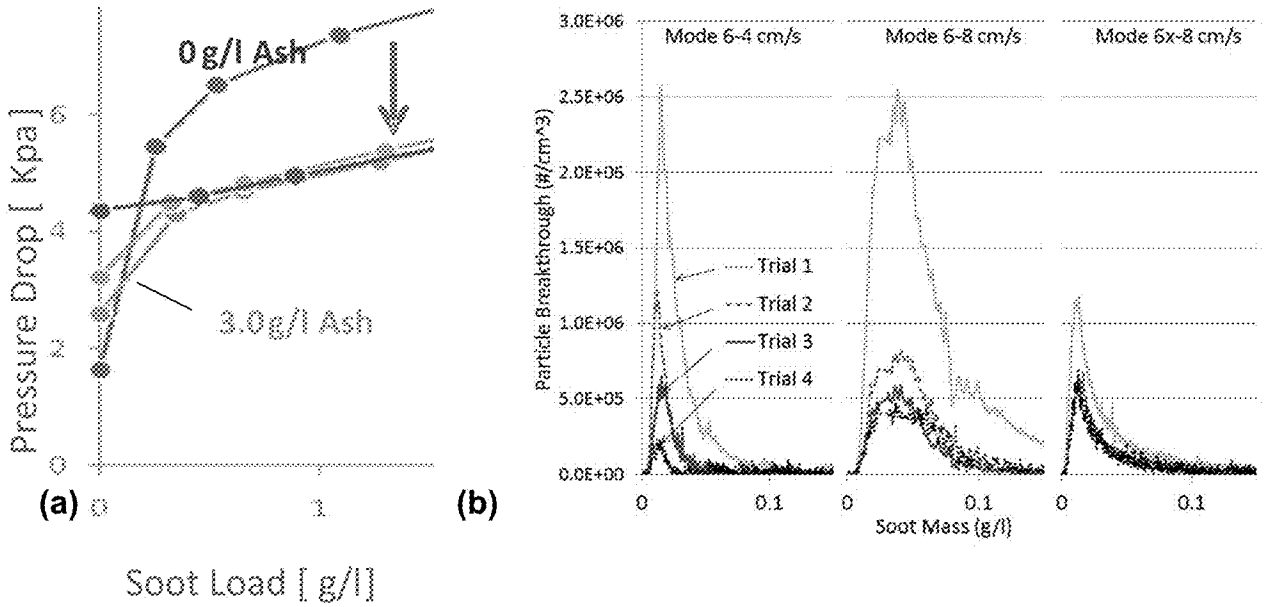
FIG. 1(*a*) shows the reduction in filter pressure drop with soot accumulation due to 3 g/L ash.

FIG. 1(*a*) illustrates results from a series of tests showing approximately 33% reduction in pressure drop with only 3 g/L ash accumulation relative to the case with 0 g/L ash for the same level of soot accumulation. Additional studies have shown benefits of the ash to reduce filter pressure drop with less than 0.25 g/L ash. In addition, FIG. 1(*b*) shows results from one such study showing small amounts of ash, less than 1 g/L, leading to a reduction in particle breakthrough (improved filter trapping efficiency) in the range of 50% to 80% relative to the case of the filter with no ash. Each "Trial" in the figure corresponds to the addition of approximately 0.25 g/L of ash.

In general, the beneficial effects of the initial thin ash membrane may be short lived in practical vehicle applications, due to the build up of additional ash which increases the filter pressure drop considerably. In other cases, the beneficial membrane may not form at all if the filter is operated in a manner which causes all of the ash to accumulate at the back of the channel, as opposed to along the channel walls. Therefore, from a filter operation standpoint, it is desirable to operate the filter in such a manner as to induce formation of a thin membrane during the initial stages of filter operation or "break-in", while preventing too much ash from accumulating along the channel walls such that the ash layer grows too thick and results in an increase in pressure drop.

In one embodiment, the initial stage of filter operation or "break-in" period may be defined as the amount of operating time or mileage required to accumulate no more than 10 g/L of ash in the filter. This amount of ash may be accumulated in less than 57,000 miles or 2,000 hours of operation in one example, however the actual mileage or operating time to accumulate 10 g/L of ash will be highly dependent on a number of factors specific to each application, including engine oil consumption, oil ash content, and filter design, among other parameters.

In a preferred embodiment, the initial stage of filter operation or "break-in" period may be defined as the period to accumulate a thin ash membrane, which may be characterized by a certain thickness, in this case 10 μm. However the membrane could be thicker or thinner in other cases, but in no cases thicker than 60 μm. Depending on the ash packing density and filter design, a 10 μm ash membrane may be established with less than 3 g/L ash or approximately 17,000 miles or 570 hours of operation, but may be more or less depending on the application. In another embodiment, the ash membrane may be less than 10 μm thick and not even fully-established, but sufficient to cover the filter surface pores.

Figure 2:
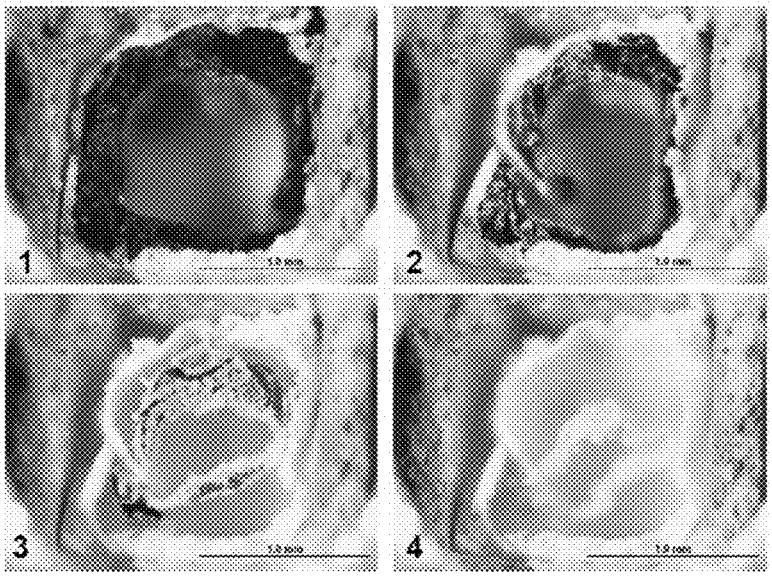
FIG. 2 is a series of images (labeled 1-4) showing soot oxidation pulling ash away from the channel walls in the absence of any flow through the channel.

Additional tests have shown an effective way for loosening and removing an existing ash layer from the channel walls if the ash layer has grown too thick. FIG. 2 shows a series of images from a single filter channel. The channel contains an ash layer upon which a layer of soot has been accumulated. Oxidation of the soot was carried out at 600° C. in the absence of any flow through the channel. With no flow in the channel, the soot exhibits cohesive forces that serve to loosen and peel the underlying ash from the channel walls during the soot oxidation process. Subsequent introduction of flow, following soot oxidation will further help to remove the ash from the walls and blow it to the back of the filter. It is not necessary to conduct the regeneration/soot oxidation at 600° C. Any temperature or conditions suitable for oxidation will suffice. The main criteria is that there be no flow or sufficiently low flow such that the drag forces imposed on the ash by the filter wall flow do not overcome the cohesive forces of the soot to pull the ash away from the channel walls.

In order to transport particles from the filter wall to the back of the filter channel, several parameters are important: particle size, flow rate, and the adhesion force between the particles and the filter wall or neighboring particles. Particle re-entrainment in the flow is most favorable when particle size is in the range of 10 μm or more, with an exemplary range from 10 μm to 800 μm, although larger particles, in particular large residual portions of the soot cake formed during or after full or partial regeneration (or ash cake layer) may also be transported, in which case the size of the cake layer fragments may be greater than 800 μm. In addition, the elevated channel velocities (higher flow rates) increase the shear or drag force applied to the particles, and thus lead to increased particle transport and elevated particle packing density at the back of the filter.

Figure 3:
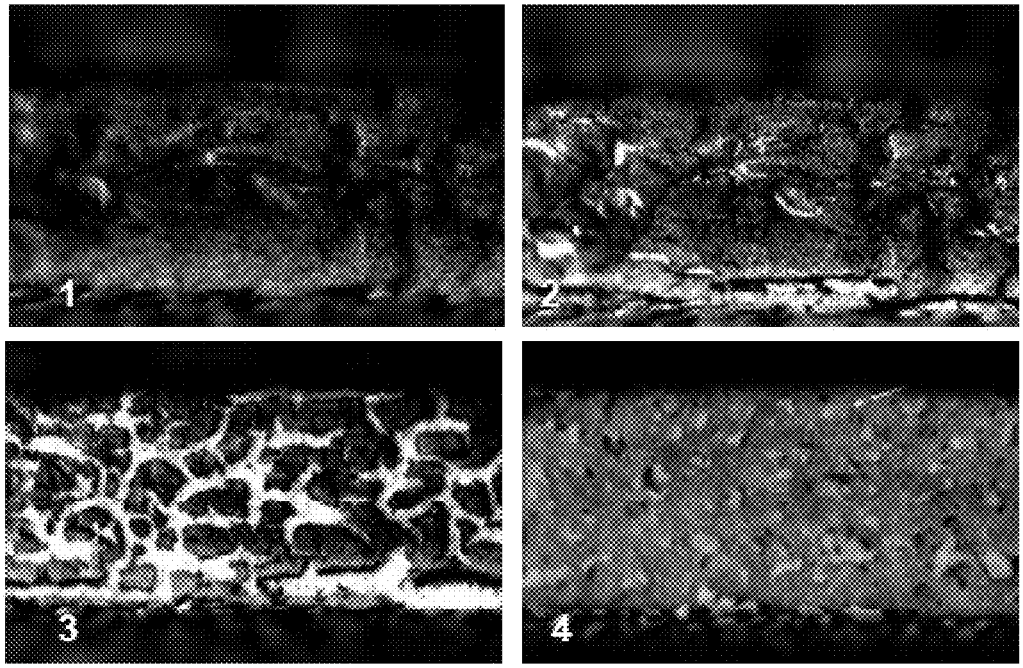
FIG. 3 is a series of images (labeled 1-4) showing localized oxidation of the soot cake forming large ash agglomerates (particularly in image 4).
Figure 4:
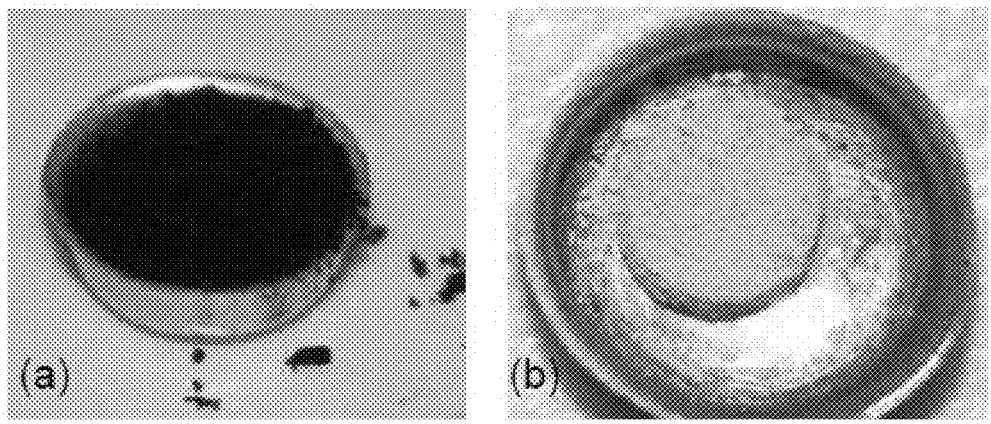
FIG. 4A shows diesel soot prior to oxidation.
FIG. 4B shows agglomerated ash following oxidation.

In order to generate large particles suitable for re-entrainment in the flow, the incoming soot and ash particles must be agglomerated in the filter. Generally, soot and ash particle sizes in the exhaust stream are between 10 nm to 800 nm. Once deposited along the filter channels, these particles cannot easily be re-entrained in the flow and moved to the back of the filter as they are much too small to be re-entrained, unless they agglomerate. Agglomeration of the soot and ash particles is significantly increased if a thick soot layer is allowed to accumulate in the filter prior to regeneration. In general, a sufficiently thick soot layer is in the range of 2 g/L to 6 g/L or more, preferably more than 4 g/L, but at least enough soot to establish a cake layer. FIGS. 3 and 4 show the ash agglomeration which occurs when a thick soot cake is built up. The soot cake oxidizes locally, forming islands of soot which shrink inward and pull the nano-size ash particles with them as well. This process concentrates the ash precursors and promotes ash agglomeration, i.e. the formation of larger ash particles. Image 4 of FIG. 3 and FIG. 4(*b*) show agglomerated ash generated following oxidation of a thick soot cake. The formation of large, micron sized ash agglomerates, or residual portions of the soot cake during regeneration, is a prerequisite for ash and soot particle transport down the filter channel.

In contrast, the initiation of regeneration (oxidation) with only a thin soot layer, or no soot layer at all, will result in less ash particle agglomeration, and smaller particle agglomerates. It will promote the formation of an ash layer on the filter surface but not the transport to the back of the filter. Ash mobility will further be decreased if the regeneration is carried out at relatively low flow rates, but not so low that the ash is peeled from the surface.

Figure 5:
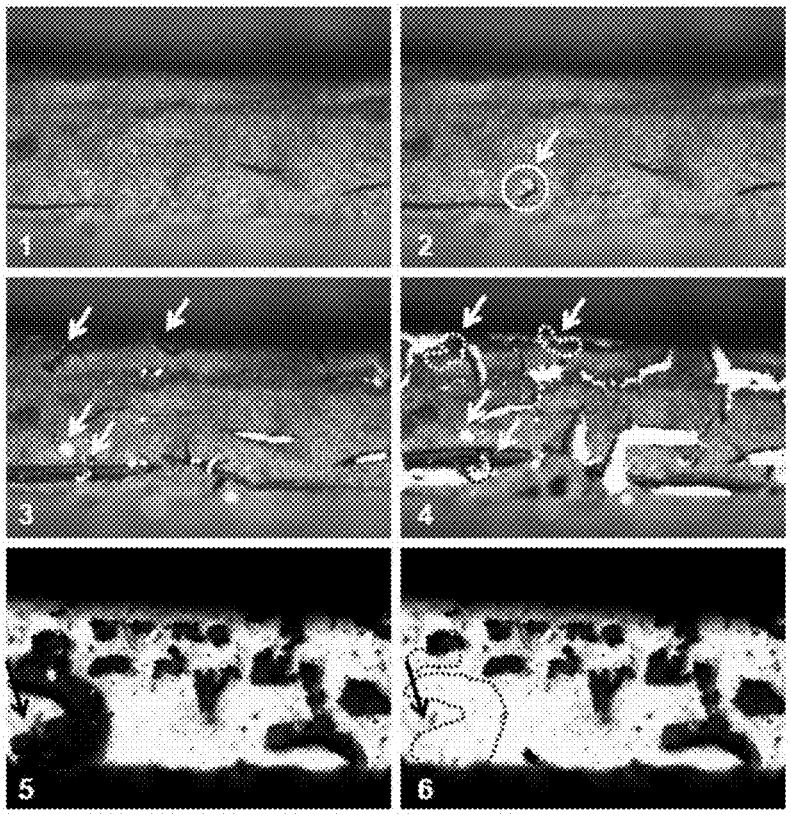
FIG. 5 is a sequence of images showing transport of ash agglomerates and bulk soot during regeneration. Outlined regions indicate particles which have been blown downstream. Flow direction is left to right and the flow was held constant at 20,000 l/hr.
Figure 6:
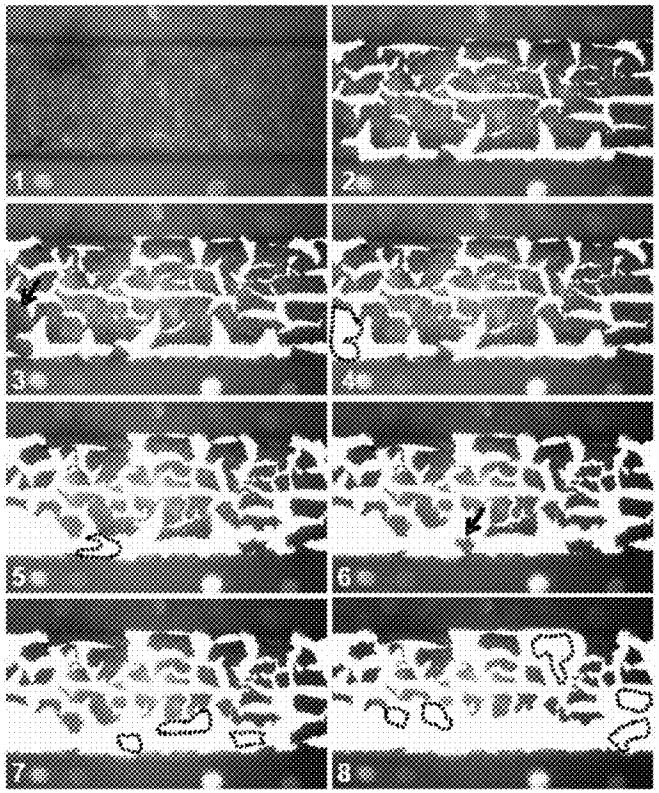
FIG. 6 is a sequence of images showing transport of ash agglomerates and bulk soot during regeneration. Outlined regions indicate particles which have been blown downstream. Flow direction is left to right and the flow was held constant at 56,000 l/hr.

When regeneration is initiated after a thick soot layer is built up, instabilities in the soot cake due to local oxidation of the soot, combined with the cohesive forces of the soot during the oxidation event, serve to loosen portions of the soot cake and enable these portions of the soot cake to be re-entrained in the flow and transported down the filter channel, as shown in FIGS. 5 and 6. The dashed outlines in these Figures correspond to soot agglomerates which have been removed from the filter surface and transported to the back of the filter. The regenerations corresponding to FIGS. 5 and 6 were carried out at a constant flow rate. The transport of the soot and associated ash to the back of the filter is due to the destabilization of the soot (reduction in contact area between the soot and the underlying filter, and associated reduction in adhesion force) during the regeneration event, as the flow is held constant for these tests. As the regeneration proceeds, additional particles are detached from the surface.

Figure 7:
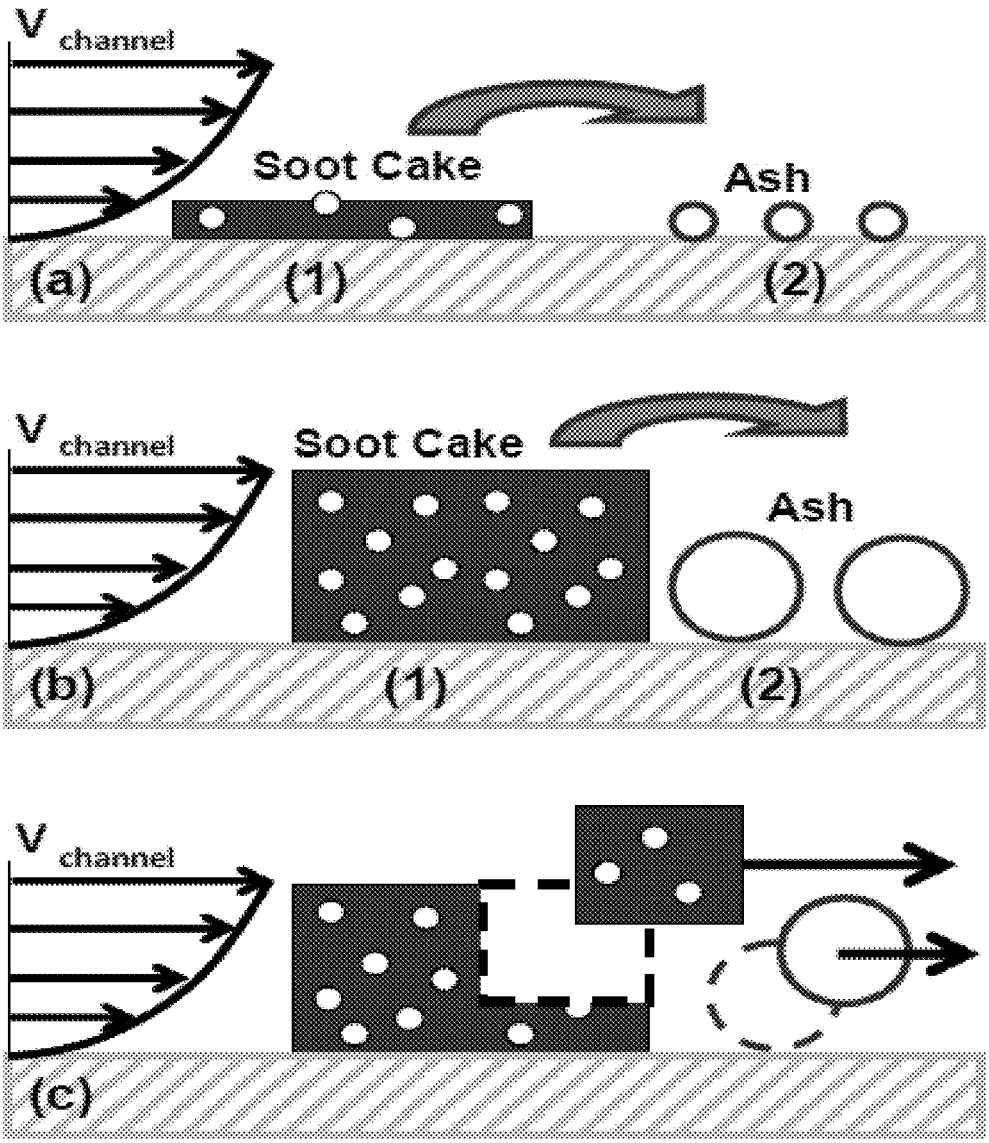
FIGS. 7A-C are schematics of particle formation and transport processes showing (a) minimal transport and formation of smaller ash agglomerates with thin soot layer, (b) and (c) formation of larger ash agglomerates and enhanced particle transport with thick soot layer. Spheres within the soot cake schematically represent small ash particles or precursors. Not shown in the radial wall velocity component for the flow through the porous channel walls.

FIGS. 7A-C provide schematic depictions of the particle agglomeration and transport processes in the cases of thick and thin soot layers prior to filter regeneration. FIG. 7(*a*) shows the regeneration process occurring in a "typical" passively regenerated filter operated near its balance point, where only a small amount of soot is deposited on the filter surface prior to oxidation. The short height of the soot cake, results in a low shear stress, due to the low channel velocity to which the soot cake is exposed, near the filter surface. In addition, this small amount of soot contains less total ash than a thicker soot cake. Combined, these factors result in the formation of smaller ash agglomerates which remain on the filter surface. It should be emphasized, however, that any regeneration strategy, including active strategies, may be employed to reduce the buildup of soot in the filter, that is to maintain the maximum soot mass in the filter below a threshold value to prevent the formation of a thick soot cake, such as that shown in FIG. 7(*a*). In one exemplary embodiment, an appropriate threshold value may be 1 g/L, however this value may be set at a higher or lower value depending on the packing characteristics of the soot, among other factors.

In contrast, FIG. 7(*b*) presents the case of a "typical" actively regenerated filter in which a much thicker soot cake is allowed to build up prior to the regeneration event. The thicker soot cake, is not only exposed to a higher channel velocity and shear stress, but also suffers from greater instabilities when the underlying soot near the filter surface is oxidized. Moreover, the thicker soot cake also contains a larger number of ash precursors (i.e. a greater total mass of ash), which results in the formation of larger ash agglomerates during the regeneration process. It should be emphasized, however, that any regeneration strategy, including passive strategies, may be employed after a sufficiently thick soot cake has been formed in the filter, such as in the example shown in FIG. 7(*b*). The thickness of the soot cake may be controlled by increasing the interval between regeneration events, irrespective of how the actual regeneration is carried out, to exceed a specific minimum threshold soot loading level prior to regeneration. In one exemplary embodiment an appropriate threshold value may be at least 2 g/L, and may be other values, such as 4 g/L or 6 g/L, however this value may be set at a higher or lower value depending on the packing characteristics of the soot, among other factors.

FIG. 7(*c*) depicts a preferred mechanism whereby portions of the partially-regenerated soot cake and associated ash agglomerates may be sheared from the surface and transported to the back of the filter. Oxidation of the underlying and neighboring soot loosens the ash agglomerates and partially-un-oxidized portions of the soot cake on the filter surface, which may then be re-entrained in the flow. Prerequisite for this re-entrainment is the size of the ash agglomerate or portion of the soot cake, (micron sized, typically in the range of 10-800 μm), as well as the local flow conditions.

Operation of the filter during the regeneration event at high flow rates further enhances transport of surface particles to the back of the filter by applying greater shear stress to the agglomerated particles (soot and ash) and results in increased packing density at the back of the filter. This is in contrast to the mechanism described in relation to FIG. 2, whereby the regeneration is performed at a low flow rate for the primary purpose of loosening the underlying ash from the channel walls, in order to facilitate its subsequent transport to the back of the channels. Although the regeneration, referenced in FIG. 2, is performed with little or no flow, the subsequent transport of the soot and ash to the back of the channels is still facilitated by high flow conditions.

The methods described in reference to FIG. 2, are thus intended to be applied in the event a substantial ash cake layer has accumulated on the channel walls, and it is desired to decrease the thickness of the ash cake layer by removing some or all of the ash and transporting it to the back of the filter channels. In other cases, where a thick ash cake layer does not exist, or it is desired to only transport the newly-deposited "surface" soot cake and ash particles to the back to the channel, the regeneration should be carried out a high flow rate.

The fundamental processes which may be manipulated to induce or inhibit particle detachment from the filter wall and transport to the back of the filter, therefore include the following mechanisms:

1. Exhaust flow rate through the filter. Increasing the flow rate has shown an increase in particle removal from the surface.
2. Particle size. The size of the particle determines the extent to which the particle interacts with the flow near the filter wall or cake layer surface. Larger particles extending farther into the flow are more susceptible to transport.
3. Adhesion between the particle and underlying filter material or cake layer. The greater the adhesion force, the greater the force required to remove the particle.
4. Contact area between the particles and filter wall or underlying cake layer. The larger the contact area, the greater the adhesion force.

In the above list, and throughput this disclosure, the word "particle" is intended to describe a larger range of deposits in the filter, including single particles, agglomerates of multiple particles, and bulk portions of the cake layer which may break or flake off the surface.

Figure 8:
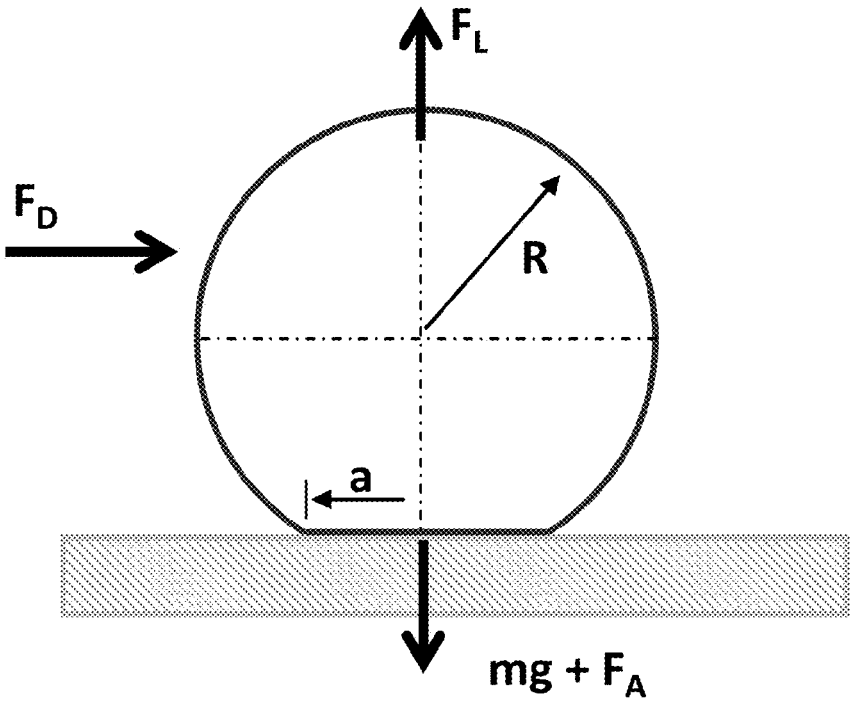
FIG. 8 is a schematic showing forces acting on a particle resting on a filter surface, as well as particle dimensions. The drag force is $F_D$, the lift force is $F_L$, the force of gravity is mg, the adhesion force is $F_A$, the characteristic dimension to describe the size of the particle is R, and the characteristic dimension to describe the contact area between the particle and filter surface is 'a'.

The forces acting on a generic particle deposited on a filter surface are schematically depicted in FIG. 8, where $F_D$ is the drag force, $F_L$ is the lift force (which may act in the positive or negative direction depending on the flow field), the force of gravity is mg, and the adhesion force is $F_A$. Further, with reference to FIG. 8, the characteristic dimension to describe the size of the particle is R, and the characteristic dimension to describe the contact area between the particle and filter surface is 'a'.

In a typical wall flow filter, the particles deposited on the filter surface or top surface of the existing cake layer are exposed to a complex flow field, which consists of an axial and radial component. The axial flow velocity or channel velocity, imposes a drag force on the particle, $F_D$. Further, the flow through the porous filter wall dictates the radial flow velocity or wall flow. Depending on the nature of the flow field, the lift force, $F_L$, may be negative in the case where the downward (radial) drag force imposed by the wall flow exceeds the upward lift force induced by the channel flow, or positive where the upward lift force induced by the channel flow exceeds the downward drag force imposed by the wall flow.

Figure 9:
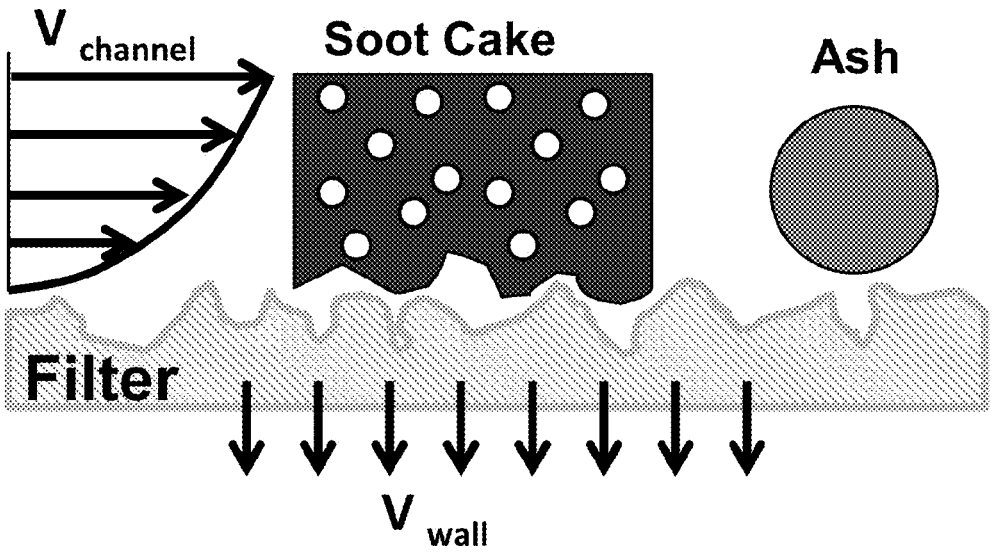
FIG. 9 is a schematic showing soot cake containing ash precursors (depicted by the spheres shown within the soot cake) and ash agglomerate accumulated on filter surface, where the surface roughness and contact area between the surface and the particles is also shown, along with the relevant flow velocities in the vicinity of the particles. Here $V_{channel}$ indicates the channel velocity and $V_{wall}$ indicates the wall velocity.

The force of adhesion, $F_A$, between the particle and filter wall or underlying cake layer, is significantly influenced by the contact area, defined with the dimension, 'a', in FIG. 8. Increasing the contact area increases the contact force and conversely, decreasing the contact area decreases the contact force. In a particulate filter, the channel walls, or filter media, exhibit some degree of surface roughness, which is schematically depicted in FIG. 9. This surface roughness also affects the contact area between the soot cake, ash cake, or soot and ash particles on the surface of the filter. Similarly, the surface of an existing soot or ash cake also exhibits some degree of surface roughness, although not pictured in FIG. 9.

The contact area, and resulting adhesion force, between the particles and filter surface or cake layer, may be controlled through a variety of means to influence the spatial distribution and transport of particles in the filter. As shown in FIGS. 5 and 6, regeneration, whereby the underlying soot cake is oxidized, is an effective means of reducing the contact area between the soot and the filter surface. For a given flow rate, reducing the contact area and corresponding adhesion force, allows the particles to be detached from the surface and transported down the filter, as shown in FIGS. 5 and 6.

Manipulation of the filter surface roughness is another means whereby the adhesion force may be controlled, as the surface roughness also influences the contact area between the particles and accumulated cake layer, and the filter surface. The particle size relative to the surface roughness directly influences the contact area. For example, small particles accumulate on a rough surface (particle size less than a length dimension characteristic of the surface roughness) may become lodged in the pores and "valleys" of the filter surface and become difficult to remove. On the other hand, large particles, spanning several asperities or "peaks", exhibiting a particle size greater than a length characteristic of the surface roughness may be more readily removed from the surface as the contact area between the particle and underlying surface is greatly reduced by the surface asperities. In this manner, the filter surface roughness may be tailored to a particular value, based on knowledge of the expected particle size (or size distribution) to modify the contact area between the particles and filter surface.

Maximizing the contact area between the particles and filter surface will aid in retaining the particles along the channel wall. In this case, the surface would be considered nominally smooth in relation to the particles. On the other hand, the use of a nominally rough filter surface, relative to the expected particle size, (or size distribution), will reduce the contact area and associated adhesive force between the particles and filter wall, and facilitate particle detachment and transport to the back of the filter.

There are many well-known means for modifying the surface area of a filter, such as by modifying the composition and particle sizes of the materials used to create the filter, applying a washcoat or similar membrane to the filter, and related means.

Catalysts of varying types, distributed on the filter surface and in the filter pores, may also be employed to preferentially oxidize the soot cake layer from the "bottom up" to reduce the contact area between the soot and the filter and decrease the adhesion force. Examples of this process were shown in FIGS. 5 and 6. On the other hand, the absence of a catalyst on the filter, (or addition of the catalyst through the feedgas stream, such as fuel-borne catalysts) may result in more "top down" oxidation and less of a loss in contact area between the soot and filter. In this manner, the use of catalysts, or lack thereof, presents an additional means for controlling the contact area between the soot and the filter during the soot oxidation process.

While modifying the contact area and associated adhesion force between the soot and filter, or neighboring particles presents one means for controlling particle transport on the filter, modifying the exhaust flow rate through the filter presents an additional method.

Figure 10:
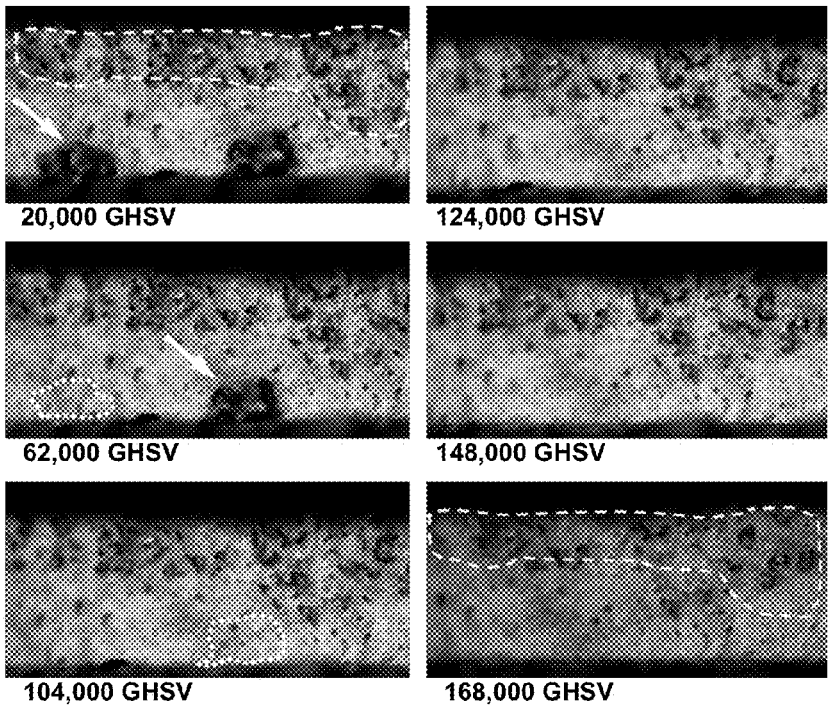
FIG. 10 is an image sequence showing detachment of residual soot cake fragments from filter surface as with increasing flow rate, characterized by gas hourly space velocity (GHSV). Flow direction is left to right.
Figure 11:
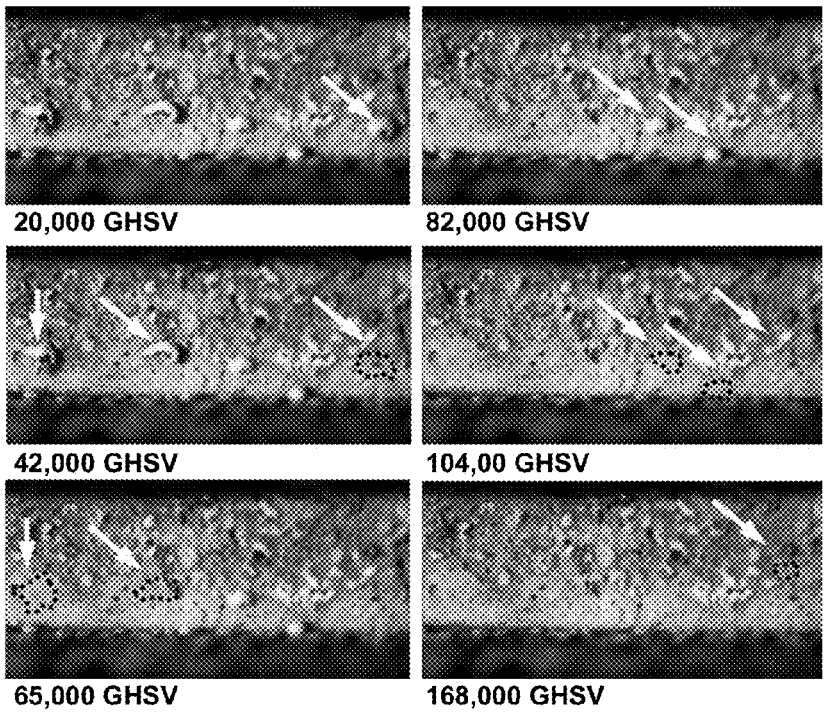
FIG. 11 is an image sequence showing detachment of residual ash particle agglomerates from filter surface with increasing flow rate, characterized by gas hourly space velocity (GHSV). Flow direction is left to right.

FIGS. 10 and 11 each show a series of images, where each image corresponds to a specific flow rate characterized by the gas hourly space velocity (GHSV) through the filter for soot and ash, respectively. Increasing the average nominal exhaust flow rate through the filter results in increased particle detachment and transport, as shown in FIG. 10 for portions of the residual soot cake and associated soot particles, and in FIG. 11 for ash agglomerates and ash particles. The outlined regions in the figures (dashed outline) mark the locations of particles which have been removed from the surface.

The effect of increasing the exhaust flow rate on particle detachment from the surface is non-trivial. Given the wall-flow nature of the filter, increasing the total flow rate through the filter results in two competing effects, namely (i) an increase in the channel velocity and associated axial shear or drag force on the particle, and (ii) an increase in the wall velocity and associated radial drag force on the particle. The particle can only then become detached from the channel wall when the flow induced shear and lift force overcomes the adhesion force between the particle and the filter wall and the radial drag force imposed by the wall flow. Note that in this case, the word radial is used to indicate the direction perpendicular to the central axis of the channel, corresponding to the direction of the flow through the porous walls.

Despite the competing forces imposed by the channel and wall flows, the series of images presented in FIGS. 10 and 11 clearly show increased particle removal from the filter surface with increasing exhaust flow. In particular, the outlined regions in the upper half of the images in FIG. 10 corresponding to flow rates of 20,000 GHSV and 168,000 GHSV clearly show fewer soot particles present in the outlined region following exposure to elevated flows. From FIGS. 10 and 11, the onset of particle detachment from the surface is observed for flow rates between 20,000 GHSV and 62,000 GHSV for soot and between 20,000 GHSV and 42,000 GHSV for ash, respectively. In one embodiment, higher flow rates through the filter can be used to facilitate particle removal from the channel walls and transport to the back of the filter.

The use of high flow rates, and high temperatures, either alone or in combination, can be used to generate more densely packed ash deposits. This may be desirable when the ash is packed in plugs at the back of the filter. Increasing ash packing density reduces the volume of the filter occupied by the ash.

FIGS. 5 and 6 and FIGS. 10 and 11 also show the influence of particle size on the resulting transport of the particles. In general, large particles and agglomerates, even large portions of the residual soot cake (with a size greater than 500 microns), are observed to detach and migrate to the back of the filter at lower flow rates than the smaller particles. Increasing the flow rate through the filter results in increased transport of smaller particles to the back of the filter. In one embodiment, a regeneration strategy which employs less frequent regenerations and allows a thicker soot cake to build up prior to regeneration may be used to form larger residual soot cake fragments during the regeneration process, or after a partial regeneration. These larger soot cake fragments and residual ash particles, which extend further into the flow, are more readily sheared from the wall and transported to the back of the filter, relative to smaller sized particles.

A number of systems and methods have been described in this disclosure to allow for preferential control of the soot and ash particle characteristics, transport, and spatial distribution in the filter. Application of this understanding enables, for the first time, active manipulation of the soot and ash deposit properties in order to reduce the deleterious impact of the deposits on filter flow restriction and pressure drop, extend filter useful life and cleaning intervals, and mitigate the negative impact on catalyst performance, among others. The following list summarizes the various means for actively controlling the soot and ash deposit properties, disclosed herein, in order to achieve the objectives listed above:

1. Reduction in back pressure due to particle depth filtration and accumulation in the filter pores. This can be achieved by building-up a thin ash membrane along the filter walls to cover the surface pores, preventing soot depth filtration. The ash membrane should be thick enough to cover the surface pores, generally only a few microns thick, in a preferred embodiment. Increasing the thickness of the ash membrane beyond a few microns, in this example, results in increased pressure drop as the ash layer thickness is further increased. In a preferred embodiment, the permeability of the ash membrane is high, to minimize pressure drop, yet the pore sizes are sufficiently small to reduce or prevent the entry into the pores of the membrane by the incoming soot. The time required to form the membrane and the membrane characteristics may be controlled as follows:
   a. Rapid membrane formation may be achieved by continuous or near-continuous regeneration of the incoming soot. That is, the soot level should be minimized by operating the filter near or above its balance point temperature for a passive system or inducing frequent regenerations in an active system, or some combination of the two. In a preferred embodiment the maximum soot level is maintained below 1 g/L but may be higher or lower in other cases, depending upon the desired soot cake thickness. Frequent or continuous oxidation of the incoming soot, where the soot layer is not fully-formed on the surface of the filter, or only of minimal thickness, results in the formation of smaller ash particles, and particles which are more strongly bound to the filter surface and less susceptible to detachment and transport to the back of the filter. In this manner, the ash membrane may be rapidly established. Formation of the ash membrane in this manner may result in some ash accumulation in the surface pores due to the continuous or near continuous oxidation process, which leaves the surface pores relatively exposed during the membrane formation process.
   b. Slow membrane formation, relative to the process describe in 1.(a). may be achieved by extending the time between regeneration or oxidation events, to allow a more substantial amount of soot (thicker soot cake layer) to build-up prior to oxidation. In this embodiment, the oxidation of the thick soot layer results in the formation of larger ash particles, and also increases the propensity for portions of the residual soot cake to be detached from the surface, either during the regeneration process, or following partial regeneration, and transported to the back of the filter. Particle transport from the surface to the back of the filter results in slower membrane formation. On the other hand, this process forms a membrane composed of larger ash particles. Further the existence of a substantial soot cake layer inhibits ash formation in the pores and may result in a membrane with more ash accumulated along the surface of the filter and little ash accumulated in the surface pores. It should be noted however, that taken to the extreme, (thick soot cake, infrequent regenerations, and high exhaust flow rates) may result in all or nearly all of the ash to be transported to the back of the filter and prevent the formation of the membrane.

In this manner, the speed at which the membrane forms, as well as the characteristics of the membrane, such as the particle size and deposition in the surface pores or on the filter surface covering the surface pores, may be controlled. Aside from reducing or preventing soot accumulation in the filter pores and the associated increase in backpressure, the formation of the membrane also enhances particle trapping efficiency. In addition to influencing the formation of the membrane by controlling the soot level in the filter prior to oxidation, other means such as the use of fuel or oil additives to increase the ash content of the soot may also be employed.

2. Extend filter cleaning interval (useful life) and reduce backpressure and catalyst degradation by sweeping the ash to the back of the channels and increasing packing density (reduction in volume) of the ash plug. The following parameters can be controlled to induce ash transport to the back of the filter:
   a. Increase exhaust flow rate through the filter. Increasing the exhaust flow rate increases the flow-induced shear on the soot and ash deposits and facilitates detachment of the ash and soot from the surface and transport to the back of the filter, as shown in FIGS. 10 and 11. High flow rates also result in increased packing density of the ash deposits in the back of the filter, thereby reducing the volume occupied by the deposits. High temperature excursions to induce ash sintering, may also be used to reduce the ash deposit volume.
   b. Increase particle size of the deposits. Accumulation of a larger amount of soot prior to regeneration results in a thicker soot cake that also contains more total ash compared to a thinner soot cake. During regeneration, the thick soot cake becomes fragmented, as shown in FIGS. 5 and 6. The soot cake fragments essentially behave as large particles which are readily detached form the surface and transported to the back of the filter (also carrying the ash with it). FIG. 5, in particular, shows the transport of a soot cake fragment larger than 500 μm in width, which clearly also contains ash deposits. Further, regeneration at higher soot levels results in the formation off larger ash particles. Regardless of the particle type, whether soot or ash, larger particles which extend farther from the surface into the flow, experience greater shear or flow-induced drag, given the nature of the velocity profile near the filter wall, and thus are more readily transported to the back of the filter than smaller particles.

c. Reduce the particle adhesion force. The particle adhesion force to the surface of the filter or to neighboring particles, may be decreased by reducing the contact area between the particles and the surface or other neighboring particles. The contact area may be reduced through oxidation of the soot. In a preferred embodiment the soot cake layer is oxidized from the "bottom-up," that is the soot adjacent to the filter wall is oxidized, reducing the contact area between the soot and the filter wall. Reducing the contact area directly reduces the adhesion force, and facilitates transport of soot cake fragments (and the ash those fragments contain) to the back of the filter. Aside from oxidation, the contact area and adhesion force may also be controlled by modifying the surface roughness, schematically depicted in FIG. 9, of the filter material itself or through the addition of a washcoat or other type of coating to the surface.

3. Decrease pressure drop by removing thick ash layers from the filter walls and re-depositing the ash in the back of the filter. The systems and methods described in 2, relate to means for systematically inducing ash migration and transport to the back of the filter channels, thus avoiding the buildup of a thick ash layer along the channel walls. In some cases however, a thick ash layer may be accumulated along the wall, intentionally or unintentionally, and it may be desired to reduce the wall ash layer thickness from time to time, and sweep the wall ash, or a portion thereof to the back of the channel. The accumulation of a high soot load (thick soot layer) on top of the wall wash, followed by regeneration with little-to-no flow through the filter may result in some of the wall ash being pulled away from the wall or loosened from the wall by the oxidizing soot as shown in FIG. 2. Subsequent high flow rate operation, following soot oxidation in this manner, promotes the transport of the ash, thus loosened and pulled from the filter walls, to the back of the filter. In addition, high temperature operation, above 650° C. may also promote local ash sintering and volume reduction, thus reducing the contact area of the ash layer with the filter wall and promote ash transport, in another embodiment.

4. Reduce pressure drop by increasing permeability of the ash deposits along the channel wall. The ash deposit permeability is influenced by the ash particle size. Larger particles which are more loosely packed result in a more permeable structure relative to small particles which are more densely packed. Means for controlling the ash particle size, based on the soot level accumulated prior to oxidation, were described in 2(b). Increasing the ash content in the soot through the additional of additives in the oil or fuel is another means for promoting ash agglomeration and particle growth.

It will be recognized by those skilled in the art that the systems and methods listed above may also be employed to control the distribution and properties of the ash deposits in the filter to achieve results other than those listed above. For example, 2 describes methods for inducing ash transport to the back of the filter. Should it be desirable, in some applications, to inhibit ash transport to the back of the filter and instead promote ash buildup on the filter walls, the opposite strategy may be employed, namely more frequent regenerations at lower soot loads and lower flow rates in order to generate smaller particles which will preferentially remain along the channel walls in a similar manner to the methods described relating to the ash membrane formation in 1.

Using the information disclosed herein, the regeneration strategy, engine control, exhaust conditions, filter design, and filter operating parameters may be modified to intentionally control and manipulate the physical properties and spatial distribution of the ash deposits. One exemplary method is described below, although any method may be employed using the elements described herein (namely control of soot layer thickness, and flow during the regeneration, as well as the means of oxidation) to achieve a desired ash packing density, ash particle size, and spatial distribution in the filter:

1. Clean Filter: Exploit continuous regeneration, which may be active or passive, or any combination of the two, (minimize soot cake build-up) during the initial stages of filter "break-in" to accelerate the formation of an ash membrane along the channel walls. Maintaining low flow rates, less than 20,000 l/hr in one embodiment, (but more or less in others) through the filter will also reduce particle detachment from the walls and transport to the back of the filter during this stage. The membrane, thus formed, provides not only a significant reduction in soot-loaded pressure drop relative to a clean filter, but also enhances the filter's filtration efficiency.
2. Extended Filter Operation: Following establishment of the filter membrane in step 1 (<10 g/L ash) switch to a periodic regeneration strategy, which can be either active or passive. Here the main objective is to regenerate the filter under high flow conditions only after a thick soot cake has accumulated, to facilitate particle transport and packing at the back of the filter and form densely packed end-plugs. This regeneration strategy should be maintained for the life of the filter.
3. Increase Ash Plug Packing: This is an optional step that utilizes short duration high temperature operation with filter internal temperatures above 700° C. to increase ash packing density and reduce ash volume in the end plug.

Figure 12:
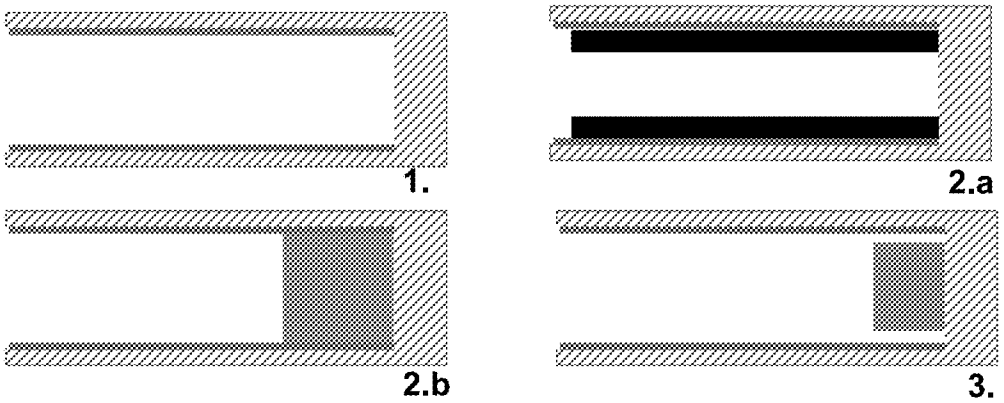
FIG. 12 is a schematic showing one possible control strategy to (1.a) establish ash membrane, (2.a) build thick soot cake, (2.b.) to facilitate ash transport to back of filter, and (3.) utilize high temperature excursion to increase ash packing density in ash plugged region at back of filter.

The steps outlined above are schematically depicted in FIG. 12. Step 1 in FIG. 12 shows the formation of a thin ash membrane along the channel walls in an ideal case with no soot cake layer build-up (ideal continuous regeneration). Step 2.a. in FIG. 12 shows the transition to a regeneration strategy employing infrequent regenerations to allow for a relatively thick soot cake to accumulate on the surface of the ash membrane. Step 2.b. shows the resulting ash build-up in the plug region at the back of the filter, which results from the transport induced by regeneration of the thick soot cake formed in step 2.a. Note that the build-up of ash in the plug region of filter shown in step 2.b. accumulates following multiple regenerations and extended filter operation. Finally, step 3 corresponds to the optional step of periodically initiating a high temperature event to promote sintering and volume reduction of the ash, particularly in the plugged region (increase ash packing density). Note that these steps result in the transport of both ash and soot in the filter, however following complete regeneration and oxidation of the soot, only the ash remains. Further, following filter cleaning or replacement, steps 1 and 2 should be repeated to rebuild the ash membrane and then pack subsequently deposited ash toward the rear of the particulate filter.

The sequence of steps listed above assumes the combination of a thin highly permeable ash membrane along with the majority of the ash densely packed at the back of the channel in the end plug (small end plug volume) is the preferred ash distribution and packing to provide optimum filter performance and reduced pressure drop. In one embodiment, if the ash can be sufficiently densely packed at the back of the filter, the filter may never need to be cleaned and the service life may be significantly extended. Typical ash packing densities are in the range of 0.1-0.4 g/cm$^3$, leaving considerable room for increasing ash packing in the end plugs.

In a preferred embodiment the thin, highly-permeable ash membrane is characterized by a thickness sufficient to prevent soot depth filtration into the filter pores, such as between 1 μm and 10 μm in one embodiment, or between 1 μm and 30 μm in another embodiment, but no more than 60 μm in another embodiment, with a permeability less than the permeability of the soot cake accumulated on top of the ash layer in the filter.

In one embodiment, the densely-packed ash at the back of the channels has a packing density of greater than 0.3 g/cm$^3$, but preferably greater than 0.5 g/cm$^3$ and less than or equal to the true density of the ash, generally in the range of 2 g/cm$^3$ to 4 g/cm$^3$, depending on the ash composition. In another embodiment, the densely-packed ash at the back of the channels is packed to a sufficient density such that the packed ash occupies less than 25% of the total filter length.

In the case where high temperature excursions, above 700° C. in one embodiment, are used to increase the ash packing density, the packing density may be expected to increase with increasing temperature. Relative to the packing density of the ash prior to heat treatment, the packing density of the ash following high temperature exposure may be increased in the range of 10% to 50%, or more in some cases, particularly with higher temperatures. In another embodiment, high temperature excursions above 850° C., may result in an increase in ash packing density greater than 100%, in some cases. The increase in packing density and corresponding reduction in ash volume following heat treatment will also depend on the ash composition and prior thermal history. For example, ash constituents with a lower sintering temperature, such as zinc phosphates may exhibit increased packing density relative to ash constituents with a higher sintering temperature, such as calcium sulfate.

Should different ash properties be desired, such as, for example, smaller particles or a thicker ash layer along the channel walls, the system operating parameters may be adjusted accordingly. If a thick ash layer is desired, the filter should be operated to continuously (as much as possible) oxidize the incoming soot to avoid the build up of a substantial soot cake. The absence of any appreciable soot cake reduces the propensity for ash agglomeration and particle transport to the back of the filter. Furthermore, should the ash layer along the channel walls become too thick, regeneration with a thick soot cake and little-to-no flow, as shown in FIG. 2, will enhance the soot-induced ash removal from the filter walls.

The thickness of the soot cake layer may be controlled through a number of means, such as by controlling the time between regenerations, varying the exhaust gas composition, and operating the combined engine and exhaust system under conditions, such as low temperature, or low $NO_x$ or $O_2$ emissions, or high soot emissions, among other conditions, to facilitate soot cake build-up prior to regeneration.

The regeneration may be initiated through a number of means well-known to those skilled in the art, including active means using in-cylinder post-injection, exhaust hydrocarbon injection, electric heaters, exhaust burners, and the like, or passively with catalyzed systems and proper control of exhaust temperature and composition using diesel oxidation catalyst, catalyzed diesel particulate filter, and the like.

The exhaust flow rate may be controlled during the regeneration process by varying engine speed and load, turbocharger and exhaust gas recirculation settings, intake throttling, the use of a bypass valve to diver flow through one or more filter banks, and other well-known means of engine control.

The surface of the filter may be catalyzed or un-catalyzed to influence the nature of the regeneration, whether top-down or bottom-up, which will affect the contact area and resulting adhesion force between the particles and filter surface. Similarly, the surface roughness of the filter may be modified to control the contact area and adhesion force. Surfaces exhibiting varying degrees of roughness, or varying catalyst levels may be used in different parts of the filter to preferentially retain particles in one region of the filter, for example, and induce particle transport in other regions of the filter.

The various techniques and procedures described herein may be implemented through the use of a system controller located in or near the engine. The controller is in communication with various elements of the engine, so as to be able to control the regeneration operation and the flow rate through the filter. The controller may also be in communication with one or more sensors, including pressure, temperature, flow, soot sensors and the like. Instructions for manipulating engine and aftertreatment system control as described herein may be contained on a computer readable storage medium in communication with the aftertreatment system controller or related control system. The controller may make a determination of filter loading state based on input from the one or more sensors, or utilize estimations from predictive models or virtual sensors. The controller may also enable the regeneration process and control the flow rate through the filter during regeneration.

In summary, there are a number of aftertreatment system configurations, filter types, and means of controlling engine and exhaust conditions well-known to those skilled in the art. The new and novel elements of this disclosure center around the manipulation of soot and ash levels at the start of the regeneration event, combined with control of flow rates through the filter during and after the regeneration event to control the resulting ash agglomerate size and transport, as well as the spatial distribution and packing of the accumulated material.

The filters described in this disclosure may be diesel particulate filters (DPF) gasoline particulate filters (GPF) or any similar or related filter which performs a similar function. The methods of control and operation described may be performed online (on the engine or vehicle) or offline (using a flow bench and oven or burner, in one example).

While particular embodiments of the invention have been shown and described, it will be obvious to those skilled in the art that various changes and modifications may be made without departing from the present invention in its broader aspects. It is intended that all matter contained in the above description and shown in the accompanying drawings shall be interpreted as illustrative and not in a limiting sense.

What is claimed is:

1. A method of controlling soot and ash properties and spatial distribution in a particulate filter to improve filter performance, the filter in communication with an exhaust flow from an engine, and having a plurality of walls defining a channel therein, the method comprising:

forming a thin highly permeable ash membrane on said walls of the filter and densely packed ash in a back of the channel by controlling a thickness of a soot cake on said walls prior to regeneration;

and by controlling an exhaust flow rate through the filter during the regeneration, wherein a controller varies an operating parameter of the engine or an aftertreatment system to control the exhaust flow rate.

2. The method of claim 1, wherein said thin highly permeable ash membrane is formed during initial stages of filter operation.

3. The method of claim 2, wherein oxidation is performed during said initial stages before a soot level reaches 1 g/L.

4. The method of claim 3, wherein oxidation is performed continuously during said initial stages.

5. The method of claim 3, wherein a flow rate is maintained at a low level during said oxidation.

6. The method of claim 1, wherein said densely packed ash is created by transporting particles having a size greater than 10 μm toward said back of said channel.

7. The method of claim 6, wherein a flow rate greater than 10,000 l/hr is used to transport said particles.

8. The method of claim 6, further comprising heating said transported particles at a temperature greater than 700° C. to increase packing density of said particles at said back of said channel.

9. The method of claim 6, wherein a layer of soot deposited on said walls is oxidized after it reaches a thickness of at least 2 g/L.

10. The method of claim 9, wherein micron-sized ash agglomerates are generated during said oxidizing.

11. The method of claim 6, wherein said transporting of particles is facilitated by varying an adhesion force between said soot cake on said filter walls and said filter walls.

12. The method of claim 11, wherein roughness of said walls of said filter is tailored to vary contact area between said soot cake and said walls, thereby varying said adhesion force.

13. The method of claim 11, wherein a catalyst is applied to said walls of said filter to vary said adhesion force.

14. A method of regenerating a particulate filter, the filter having a plurality of walls defining a channel therein, the method comprising:

forming a thin highly permeable ash layer on said walls by regenerating said filter during initial stages of filter operation before a layer of soot having a thickness of 1 g/L has formed on said walls; and inducing formation of ash particles and then transporting said ash particles to a back of said channel by regenerating said filter thereafter only when a layer of soot having a thickness greater than 2 g/L has formed on said walls.

15. The method of claim 14, wherein a flow rate of less than 20,000 l/hr is maintained during said regeneration performed during said initial stage of filter operation.

16. The method of claim 14, wherein said regeneration is performed continuously during said initial stages.

17. The method of claim 14, wherein a flow rate of greater than 20,000 l/hr is maintained during said regenerating thereafter.

18. The method of claim 14, further comprising heating said transported particles at a temperature greater than 700° C. to increase packing density of said particles at said back of said channel.

19. A system configured to control soot and ash properties and spatial distribution in a particulate filter to improve filter performance, the system comprising:

an engine and particulate filter system, said particulate filter have a plurality of walls defining a channel therein, wherein said particulate filter comprises a thin, highly permeable ash membrane coating said walls to prevent soot depth filtration and a densely packed ash plug at the back of said filter channel; and a controller configured to modify engine and aftertreatment operating parameters to create said thin highly permeable ash membrane and said densely packed ash plug by controlling a thickness of a soot cake on said walls and by controlling a flow rate through said filter.

20. The system of claim 19, wherein said controller regenerates said filter during initial stages of operation before the soot cake having the thickness of 1 g/L has formed on said walls.

21. The system of claim 20, wherein said controller maintains the flow rate of less than 20,000 l/hr during said regenerations during said initial stages.

22. The system of claim 20, wherein said controller regenerates said filter thereafter when the soot cake having the thickness of at least 2 g/L has formed on said walls.

23. The system of claim 22, wherein said controller maintains the flow rate in excess of 20,000 l/hr during regenerations thereafter, to transport particles toward said back of said channel.

24. The system of claim 23, wherein said controller heats said transported particles at a temperature greater than 700° C. to increase packing density of said particles at said back of said channel.

* * * * *